US006712575B1

(12) United States Patent
Tuma et al.

(10) Patent No.: US 6,712,575 B1
(45) Date of Patent: Mar. 30, 2004

(54) PROCESS FOR MANUFACTURING A CAN WITH A POLYGONAL CROSS SECTION AND A CAN WITH A POLYGONAL CROSS SECTION

(75) Inventors: Joao Vincente De Masi Tuma, Rio Verde (BR); Jose Augusto Oliveira Souza, Rio Verde (BR)

(73) Assignee: Brasilata S.A. Embalagens Metalicas, Sao Paulo (BR)

( * ) Notice: Subject to any disclaimer, the term of this patent is extended or adjusted under 35 U.S.C. 154(b) by 0 days.

(21) Appl. No.: 09/424,009

(22) PCT Filed: Mar. 30, 1999

(86) PCT No.: PCT/BR99/00023

§ 371 (c)(1),
(2), (4) Date: Jan. 11, 2000

(87) PCT Pub. No.: WO99/51373

PCT Pub. Date: Oct. 14, 1999

(30) Foreign Application Priority Data

Apr. 1, 1998 (BR) ..... 9801887

(51) Int. Cl.[7] ..... B21D 41/28; B21D 41/30

(52) U.S. Cl. ..... 413/2; 29/457; 29/469.5; 29/521; 72/370.06; 72/370.08; 72/370.23; 72/370.26; 413/73; 413/75; 413/77; 220/669

(58) Field of Search ..... 220/561, 669, 220/4.01, 4.04, 601, 610, 615, 617, 619, 620, 666, 667, 670, 671, 672, 673, 674, 677, 682, 689, 916; 29/457, 469.5, 521; 72/367.1, 370.06, 370.08, 370.23, 370.26; 413/69, 2, 71–77

(56) References Cited

U.S. PATENT DOCUMENTS

| | | | | |
|---|---|---|---|---|
| 2,114,137 A | | 4/1938 | Conner | |
| 3,401,826 A | * | 9/1968 | Anthony | 220/671 |
| 3,547,299 A | * | 12/1970 | Kepple | 220/674 X |
| 3,759,203 A | | 9/1973 | Frankenberg | |
| 4,485,924 A | | 12/1984 | Ripoll et al. | |
| 5,902,086 A | * | 5/1999 | Enoki | 413/76 |

FOREIGN PATENT DOCUMENTS

| | | |
|---|---|---|
| DE | 2 053 053 | 5/1972 |
| DE | 295 14 035 | 2/1996 |
| FR | 2 125 149 | 9/1972 |
| FR | 2 187 620 | 1/1974 |
| GB | 1 303 950 | 1/1973 |

* cited by examiner

*Primary Examiner*—Lee Young
*Assistant Examiner*—Niki M. Eloshway
(74) *Attorney, Agent, or Firm*—Darby & Darby

(57) ABSTRACT

A process for manufacturing a can with a polygonal cross-section and a can with a polygonal cross-section, the process comprising the steps of milling the cylindrical lateral wall of a tubular body (10), providing said wall with a plurality of circumferential ribs (20) which are continuous and axially spaced from each other and defined by a certain degree of radial plastic deformation of the respective circumferential region of the cylindrical lateral wall of the tubular body (10); expanding the formed tubular body (10), deforming it, in order to define longitudinal edges (12) in whose region the circumferential ribs (20) are eliminated; and double-seaming a bottom and an upper wall of the can to the tubular body (10). This process defines a can having any polygonal cross-section and circumferential ribs (20) on the lateral wall thereof, between the longitudinal edges (12).

4 Claims, 3 Drawing Sheets

PROCESS FOR MANUFACTURING A CAN WITH A POLYGONAL CROSS SECTION AND A CAN WITH A POLYGONAL CROSS SECTION

FIELD OF THE INVENTION

The present invention refers to a process for producing cans with a polygonal, usually square, cross-section, having a tubular body with a longitudinal lateral seam.

BACKGROUND OF THE INVENTION

There are known cans which have a cylindrical tubular body obtained by conventional operations of cutting the metallic sheet, calendering the sheet to a cylindrical tubular shape and longitudinally welding the sheet for laterally closing the body.

Aiming at increasing the structural resistance of the lateral wall of the can body, the latter is often submitted to an operation, usually in a milling machine, for providing the lateral wall with a certain number of circumferentially reinforcing ribs, which are axially spaced from each other and slightly projecting inwardly of the can body.

Said ribs are obtained by deformation of the cylindrical lateral wall of the can body, allowing to increase the structural resistance of the can in the radial direction and, consequently, to use a thinner plate for manufacturing the can, thus relevantly reducing the cost of the final product.

Nevertheless, the above mentioned constructive solution is only economically and industrially viable when applied to cylindrical cans, in which the ribs are circumferentially developed, without interruption and without weakening the structure of the can in the axial direction. In the cylindrical cans, the provision of the continuous circumferential ribs does not reduce the resistance of the can against axial compression forces in a degree sufficient to impair the normal operation of the can, being therefore possible to compensate the thickness reduction of the metallic sheet by providing said reinforcing ribs.

However, in the case of cans with a polygonal cross-section, more specifically the cans with a square section and with continuous round longitudinal edges, the provision of said continuous circumferential reinforcing ribs, in order to increase the resistance of the walls against radial forces and to allow a corresponding thickness reduction in the metallic sheet, has not proven to be convenient because said ribs weaken, in an unacceptable manner, the longitudinal edges of the can, which suffer a great reduction in their resistance against axial compression forces, impairing the operation of the can. The attempts to compensate the thickness reduction in the metallic sheet of cans with a square cross-section, by providing continuous circumferential ribs, have not reached a satisfactory result, due to the degree of weakness produced in the longitudinal edges of the can.

However, the interruption of the circumferential ribs in the region of the longitudinal edges of the can requires those ribs to be produced only on the lateral wall portions, by rather complex operations which lead to the production of undesirable wrinkles in the end regions of each rib extension. These inconveniences have prevented the cans with a polygonal, usually square cross-section, from having the thickness reduction of the metallic sheet compensated by the provision of circumferential reinforcing ribs.

DISCLOSURE OF THE INVENTION

Thus, it is an objective of the present invention to provide a process for manufacturiong a can with a polygonal, usually square cross-section, which allows, through simple operations, to provide said can with circumferential reinforcing ribs on the lateral walls, without provoking weakness in the longitudinal edges of the can and allowing to reduce the thickness of the metallic sheet which forms the lateral walls of the can.

A further objective of the present invention is to provide a can with a polygonal cross-section, whose tubular body is provided with circumferential reinforcing ribs, which are interrupted in the longitudinal edges of the can.

The process for manufacturing the can with a polygonal cross-section comprises the initial step of forming, from a metallic sheet, a tubular body having a cylindrical lateral wall with a longitudinal seam.

According to the invention, the manufacturing process further comprises the steps of:

- milling the cylindrical lateral wall of the tubular body, in order to provide said wall with a plurality of circumferential ribs, which are continuous, axially spaced from each other and defined by a certain degree of radial plastic deformation of the respective circumferential region of the cylindrical lateral wall of the tubular body;
- expanding the tubular body of the can to the desired polygonal cross-section, deforming its lateral wall in order to define longitudinal edges, in whose region the circumferential ribs are eliminated; and
- double-seaming a bottom and an upper wall of the can to the tubular body of polygonal cross-section.

According to the new process, the steps for forming the can body are simple, do not require complex proceedings and are the same as those generally used, until the point of laterally closing the tubular body of the can. However, from this point on, the steps for forming the cans with a polygonal cross-section are distinct from those already known. The tubular body is then provided with the continuous circumferential ribs, which are eliminated in the longitudinal edges of the can during the step of expanding the tubular body from the original cylindrical shape to the desired polygonal tubular shape.

The dimensioning of the deformation degree of the lateral wall, in order to form the ribs, is effected in order to allow that, after the step of expanding the tubular body to the polygonal shape, the ribs are practically eliminated in the region of the longitudinal edges of the can, maintaining the structural integrity of the columns defined by said longitudinal edges, said ribs however being still maintained along the respective lateral wall portions of the tubular body, which is now polygonal, increasing the resistance of these lateral wall portions and allowing a substantial reduction in the thickness of the metallic sheet, without impairing the structure of the can.

BRIEF DESCRIPTION OF THE DRAWINGS

The invention will be described below, with reference to the attached drawings, in which.

BEST MODE OF CARRYING OUT THE INVENTION

Figure 1:
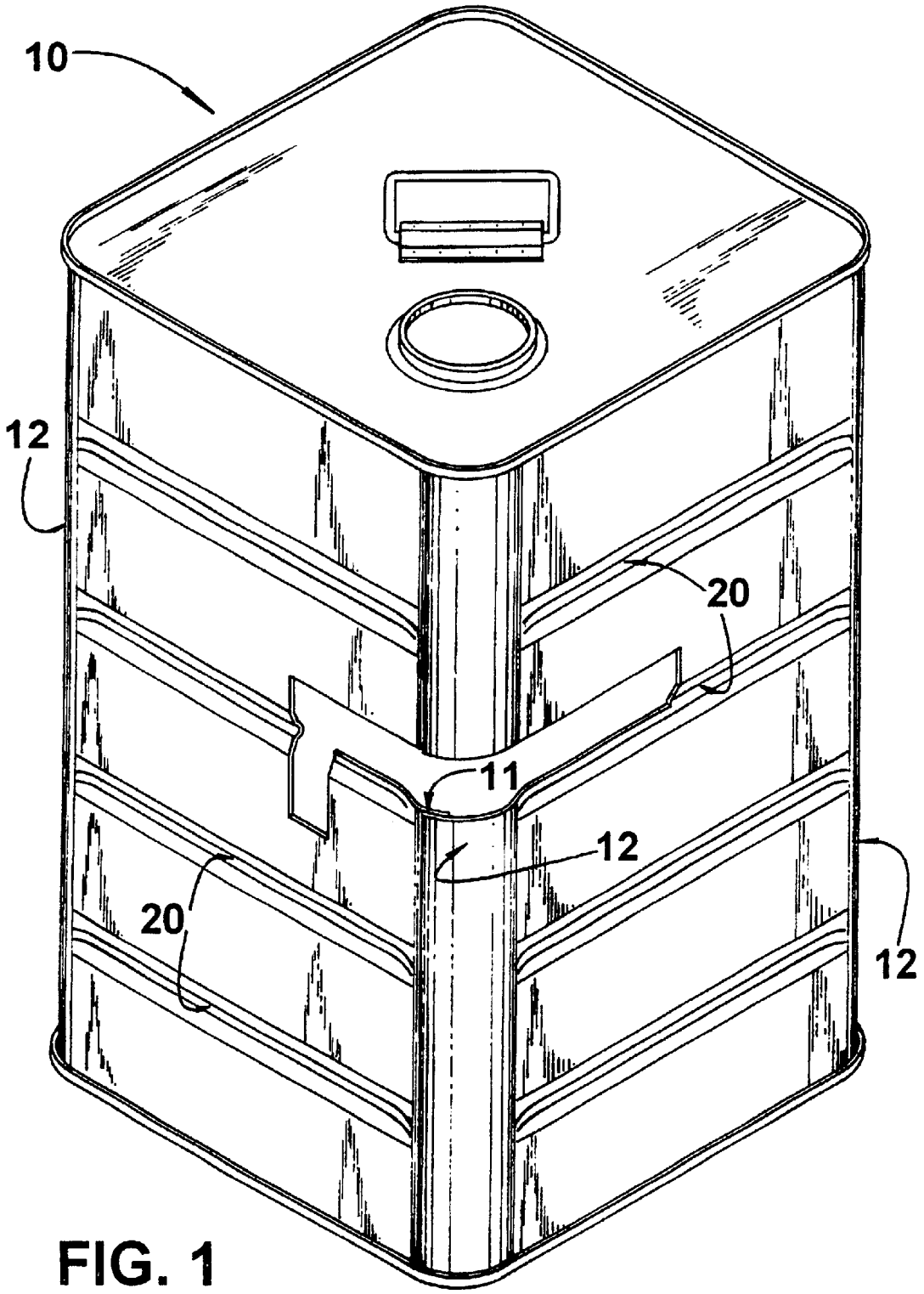
FIG. 1 illustrates a partially cut perspective view of a can with a square section, provided with circumferential ribs according to the present invention.

As illustrated in FIG. 1, the present invention is intended to be applied in the manufacture of cans with a polygonal cross-section, usually 9 liter cans with a square section.

The present process requires the known steps for forming a tubular body, such as cutting a metallic sheet of a predetermined thickness and with dimensions calculated so as to be able to form, after being calendered, a cylindrical tubular body 10 with a perimeter which is substantially equal to the perimeter of the polygonal cross-section of the can to be produced. The lateral closing of the tubular body 10 is usually obtained by mutually longitudinally welding the end edges of the calendered metallic sheet, forming a longitudinal seam 11.

Figure 2:
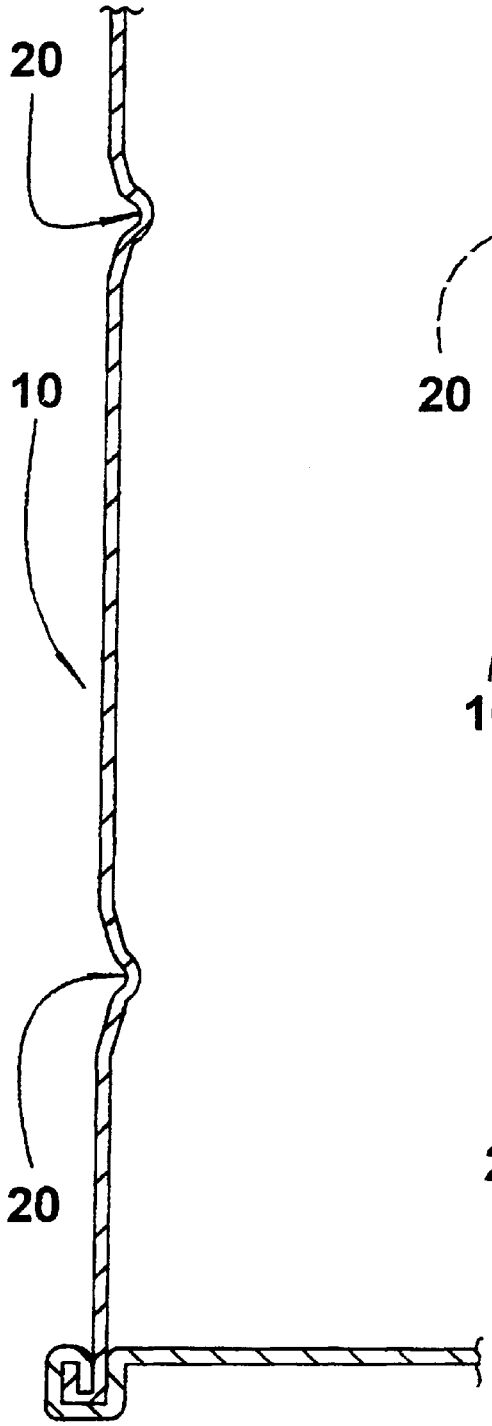
FIG. 2 is a magnified partial longitudinal sectional view of a lateral wall portion of the can of FIG. 1, illustrating a possible cross-section for the ribs.
Figure 3:
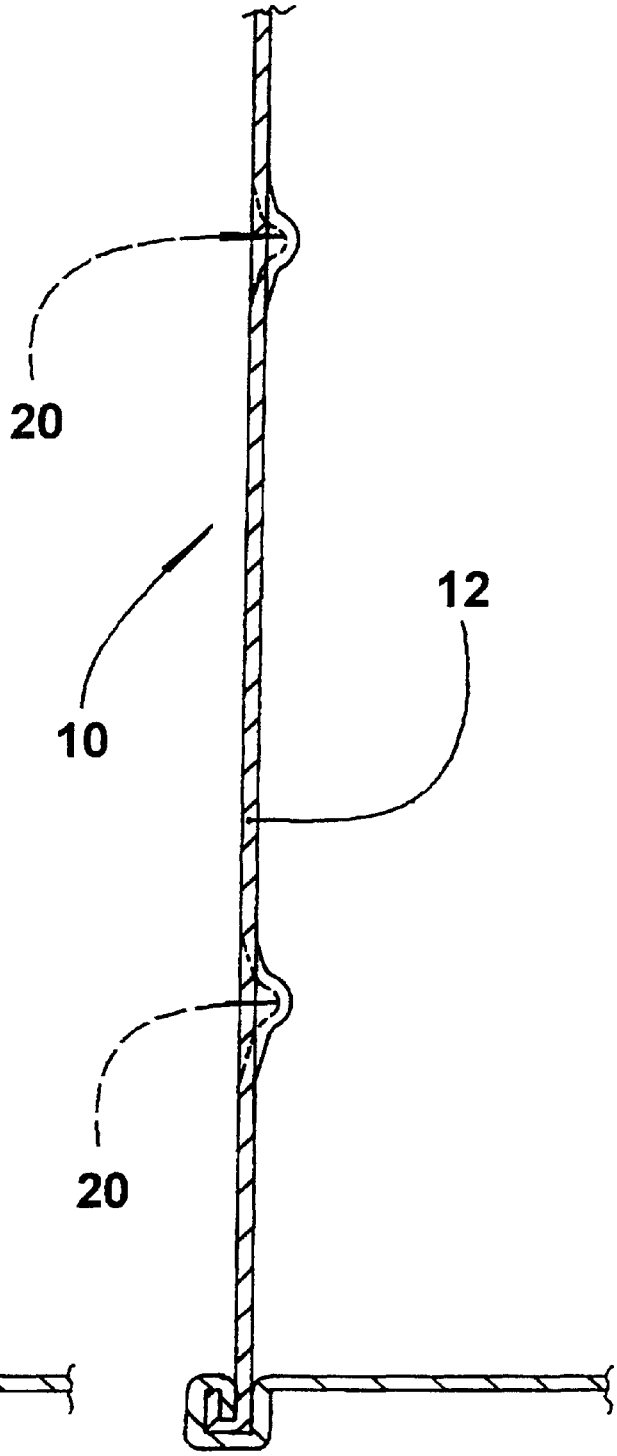
FIG. 3 is a magnified partial longitudinal sectional view of a longitudinal edge portion of the can of FIG. 1, illustrating the reverse deformation of the circumferential ribs in the region of said edges.
Figure 4:
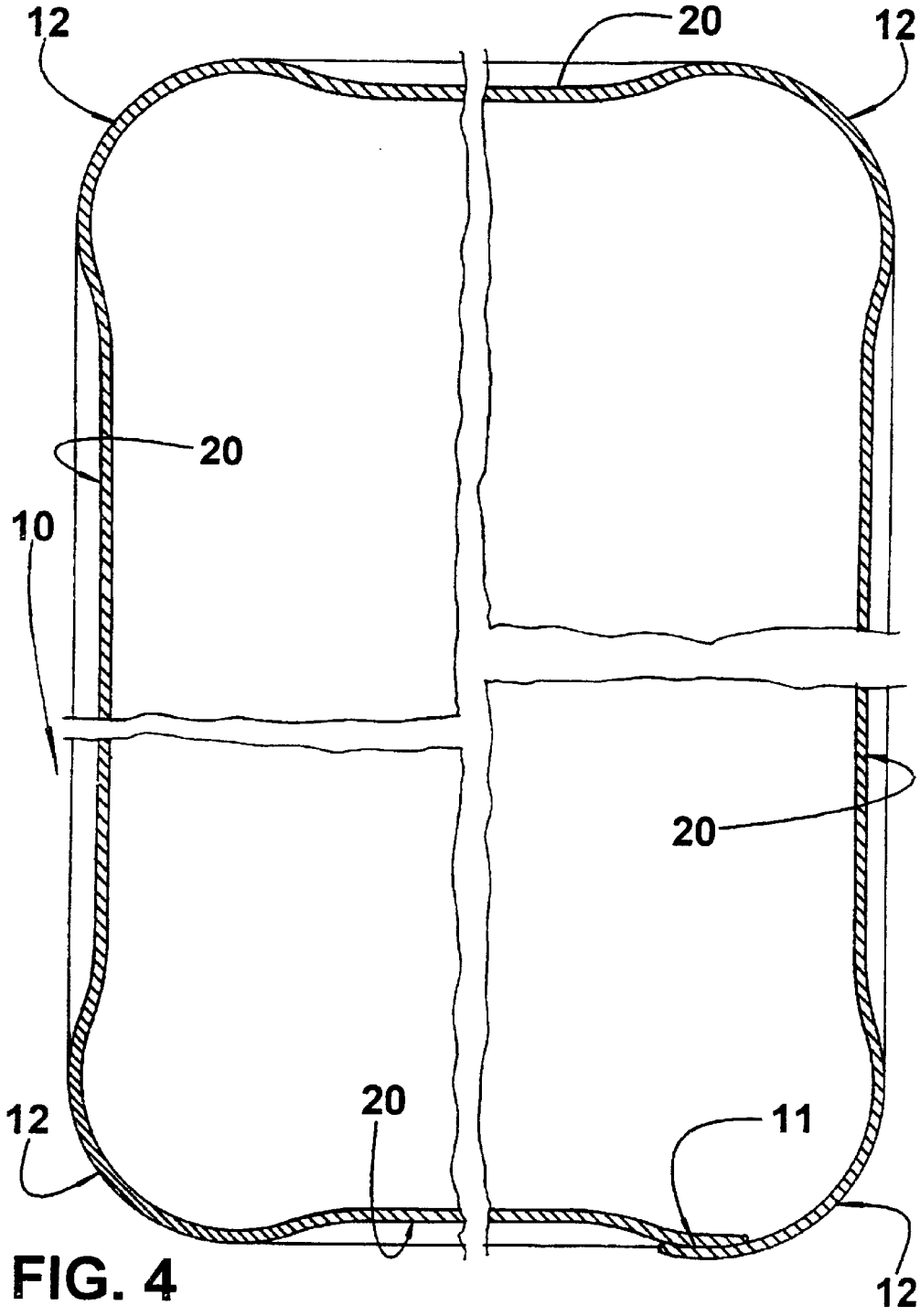
FIG. 4 is a magnified cross-sectional view of the can of FIG. 1, taken along a rib extension on a lateral wall portion of the can, illustrating the change in the rib profile in the region of the longitudinal edges.

According to the process proposed herein, the tubular body 10, still in the calendered cylindrical form, is milled in a milling machine (not illustrated), of any adequate known construction, so that the cylindrical lateral wall thereof be circumferentially and radially inwardly deformed, as illustrated in FIGS. 1, 2 and 4, being thus provided with a plurality of circumferential ribs 20, which are continuous and radially projecting inwardly to the can, along the whole perimeter thereof.

The deformation degree of the lateral wall of the tubular body 10 is dimensioned to increase the structural resistance of the lateral wall in the radial direction, allowing a reduction of up to about 15% in the thickness of the metallic sheet.

In order that the ribs 20 do not weaken the longitudinal edges 12 of the can, they are eliminated in these regions of the longitudinal edges during the step of expanding the tubular body 10 in an adequate equipment (not illustrated), to the desired polygonal cross-section shape. In this step of expanding the tubular body 10, the radial forces applied thereon, in order to form the arcuated longitudinal edges 12, are sufficient to deform the ribs 20 in a reverse manner is these regions, practically eliminating said ribs in terms of structural influence on the columns defined by said longitudinal edges 12.

Thus, it is possible to provide the longitudinal ribs 20 only in the median portions of the lateral wall, leaving unaltered the profile of the latter in the region of the edges.

After the expansion of the tubular body 10, the step of double-seaming the bottom and the upper wall of the can to the tubular body 10 of polygonal cross-section is carried out.

With this new process, it is possible to obtain a can with a polygonal cross-section, with the thickness of the metallic sheet being relatively reduced and structurally reinforced by circumferential ribs, which are disposed on planes transversal to the can axis and obtained by radial deformation of the lateral wall of the tubular body, and which are eliminated in the region of the longitudinal edges of the can, in order to maintain the structural integrity of said edges in the axial direction.

In the illustrated embodiment, the circumferential ribs 20 have a round V section. However, it should be understood that this basic shape may suffer certain modifications, without neglecting the desired radial reinforcing function.

What is claimed is:

1. A process for manufacturing a can body with a polygonal cross-section, comprising the steps of:

forming, from a metallic sheet, a tubular body having a cylindrical lateral wall with upper and lower ends and a longitudinal seam;

milling the cylindrical lateral wall of the tubular body to form a plurality of circumferential ribs transverse to the longitudinal axis of the tubular body between the upper and lower ends of the tubular body which ribs are continuous and axially spaced from each other and defined by a degree of radial plastic deformation of the respective circumferential region of the cylindrical lateral wall of the tubular body;

expanding the tubular body with said axially spaced circumferential ribs to form a can body of a desired polygonal cross-section having a plurality of walls with two adjacent walls connected at a corner;

deforming the can body of polygonal cross-section during the expanding step to form at each corner of the polygonal can body a continuous straight region in the axial direction of the can body for the entire length of the can body between its upper and lower ends with the circumferential ribs being eliminated from the longitudinal regions; and seaming a bottom and an upper wall of the can to the body of polygonal cross-section.

2. Process, as in claim 1, wherein the milling of the cylindrical lateral wall to form the circumferential ribs, is effected from the outside to the inside of said can.

3. Process as in claim 1 wherein each said corner longitudinal region has a portion that forms a part of each of the two can body walls which form the corner.

4. Process as in claim 3 wherein each portion of each said corner longitudinal region is substantially flush with the can body wall to which it extends.

* * * * *

UNITED STATES PATENT AND TRADEMARK OFFICE

CERTIFICATE OF CORRECTION

PATENT NO. : 6,712,575 B1
DATED : March 30, 2004
INVENTOR(S) : Joao V. De Masi et al.

It is certified that error appears in the above-identified patent and that said Letters Patent is hereby corrected as shown below:

Title page,
Item [30], Foreign Application Priority Data, please delete "April 1, 1998 (BR) …….9801887" and substitute -- April 4, 1998 (BR) …….9801887 --.

Signed and Sealed this

Twenty-seventh Day of July, 2004

JON W. DUDAS
*Acting Director of the United States Patent and Trademark Office*